United States Patent [19]

Thomanek

[11] 4,175,491

[45] Nov. 27, 1979

[54] WARHEAD AND ANTI-TANK MISSILE CONSTRUCTION

[75] Inventor: Franz R. Thomanek, Landkreis Schrobenhausen, Fed. Rep. of Germany

[73] Assignee: Messerschmitt-Bolkow-Blohm Gesellschaft mit beschrankter Haftung, Munich, Fed. Rep. of Germany

[21] Appl. No.: 858,335

[22] Filed: Dec. 7, 1977

Related U.S. Application Data

[63] Continuation of Ser. No. 692,928, Jun. 4, 1976, abandoned, which is a continuation of Ser. No. 767,529, Oct. 14, 1968, abandoned, which is a continuation-in-part of Ser. No. 670,520, Sep. 21, 1967, abandoned.

[30] Foreign Application Priority Data

Oct. 8, 1966 [DE] Fed. Rep. of Germany ..... 89257
Oct. 14, 1967 [DE] Fed. Rep. of Germany ..... 94951

[51] Int. Cl.[2] ..... F42B 13/10

[52] U.S. Cl. ..... 102/56 SC; 102/9; 102/7.4; 244/3.25; 244/3.27

[58] Field of Search ..... 102/4, 5, 7.4, 20, 34.1, 102/49.5, 49.6, 56, 61; 244/3.25, 3.27

[56] References Cited

U.S. PATENT DOCUMENTS

| | | | |
|---|---|---|---|
| 1,292,390 | 1/1919 | Davidson | 102/56 |
| 1,301,098 | 4/1919 | Bull | 102/5 |
| 1,313,875 | 8/1919 | Borel | 102/5 |
| 1,318,926 | 10/1919 | Settle | 102/4 |
| 1,318,954 | 10/1919 | Barlow | 102/7.4 |
| 2,044,819 | 6/1936 | Taylor | 102/4 |
| 2,379,257 | 6/1945 | Scott | 102/61 |
| 2,442,528 | 1/1948 | Beattie | 102/34.1 |
| 2,654,320 | 10/1953 | Schmid | 102/4 |
| 2,701,525 | 2/1955 | Hickman | 102/49.6 |
| 3,047,259 | 7/1962 | Tatnall et al. | 102/4 |
| 3,112,906 | 12/1963 | Zeyher | 102/4 |
| 3,145,656 | 8/1964 | Cook et al. | 102/56 |
| 3,217,647 | 11/1965 | Thomanek | 102/20 |
| 3,636,877 | 1/1972 | Eaton | 102/49.5 |

FOREIGN PATENT DOCUMENTS

| | | | |
|---|---|---|---|
| 618654 | 12/1926 | France | 102/4 |
| 218109 | 3/1942 | Switzerland | 102/7.4 |
| 473958 | 10/1937 | United Kingdom | 102/4 |

*Primary Examiner*—Verlin R. Pendegrass
*Attorney, Agent, or Firm*—Toren, McGeady and Stanger

[57] ABSTRACT

A warhead for an anti-tank projectile or a rocket propelled missile includes a warhead body with a casing having a plurality of concave shaped-charge type liners arranged around the periphery and surrounding the interior explosive charge and in a plurality of planes extending along the axis of the warhead.

The explosive charge forms a portion of the body of a rocket propelled missile which includes a nose having a telescopic rod which is extendable from the tip and which is actuated upon impact at the target zone to initiate explosion of the explosive charge when at least one of the charge liners is at a height which corresponds to the maximum height of the target, for example, a tank. The missile body carries a plurality of flaps which may be moved outwardly or a parachute which may be ejected, such as by suitable operating mechanism, or by the withdrawal of a covering such as at the head of the missile to provide a braking effect on the missile to cause the axis of the projectile to adjust to a direction substantially perpendicular to the tangent of its trajectory and to cause the forward speed to become considerably reduced. The missile also advantageously includes means for restabilizing the missile after it has been adjusted to a substantially vertical drop by control devices such as tail fins or a parachute which is ejected from the nose of the missile and which effects the reversal thereof to a position in which the tail extends downwardly.

3 Claims, 6 Drawing Figures

WARHEAD AND ANTI-TANK MISSILE CONSTRUCTION

CROSS REFERENCE TO RELATED APPLICATION

This is a continuation of application Ser. No. 692,928 filed June 4, 1976, now abandoned, which is in itself a continuation of application Ser. No. 767,529 filed Oct. 14, 1968, now abandoned, which in turn is a continuation-in-part of Ser. No. 670,520 filed Sept. 21, 1967, now abandoned.

SUMMARY OF THE INVENTION

This invention relates, in general, to the construction of missiles and warheads therefor and, in particular, to a new and useful missile having means for controlling its trajectory such that it assumes a substantially vertical end trajectory and to a missile which is provided with a device for triggering the explosive charge at a time when an explosive charge liner thereof is an altitude corresponding to the maximum height of the target, and to a method of firing the missile or projectile.

The present invention is an improvement over the prior art, particularly in respect to the construction of a missile having means for obtaining a stronger curving of its trajectory to achieve a substantially vertical angle of incidence to the target area and also in respect to the provision of a missile having a warhead constructed with a plurality of charge liners arranged in separate planes, at least one of the charge liners being at a height substantially equal to the maximum height of the normal target.

By constructing the warhead with an outer casing having a plurality of concave charge liners arranged in separate planes along the axis of the missile and with the liners of each plane staggered, there is provided a warhead which will guarantee an optimum hit and kill probability in combat against heavily armored targets, particularly, armored vehicles. The construction is such that the destructive effect of a single warhead will extend to cover several target objects which may be relatively far apart.

The known measures for obtaining a stronger curving of the trajectory and an acceptable angle of incidence to the target have proven to be insufficient to effect braking of the missile so strongly that the impact velocity of the projectile is reduced below the permissible limit. Exterior ballistics teach that while in theory a trajectory which terminates in an asymptote, in practice, depending among other things on the amount of air resistance, terminates with an angle of incidence deviating from 90°. The increase of air resistance results in a shortening of the trajectory and in greater curving. Although the angle of incidence can be increased by increasing the air resistance, the remaining path of the missile still is parabolic and an angle of incidence of precisely 90° has never been achieved prior to the present invention. For this reason, all prior publications which when referring to a vertical angle of incidence are understood to mean that on the basis of around about distribution of splinters or shrapnel-type projectiles, in the end only an angle of incidence of approximately 90° in the widest sense is achieved. This is because in these instances, such an angle is fully sufficient to achieve a satisfactory splinter effect. A real approximation of the ideal condition was not necessary up to the present time.

The situation is different with respect to armor-piercing projectiles according to the present invention. Here the closest approximation to an angle of incidence of 90° is a prerequisite for optimum efficiency of the projectile. This defines the task on which the invention is based and it consists in perfecting the prior methods and devices for braking projectiles in their trajectory in order to achieve a vertical angle of incidence to the target and to enable them to operate with sufficient precision to accomplish their armor-piercing effect.

In accordance with the method of the invention, the projectile is destabilized at a predetermined point in its ballistic trajectory in such a manner that the axis of the projectile takes a substantially perpendicular position relative to a tangent to the trajectory and the forward speed is considerably reduced. Thereupon, the projectile is restabilized so that its axis is again brought into the direction of the trajectory tangent and the fall speed is increased. The invention, inter alia, is based on the realization that is is necessary to utilize the braking effect of a projectile in a position perpendicular to the flight direction if the braking surfaces of the braking means which are employed are to be maintained sufficiently small so that they reduce the impact velocity only to the extent which is absolutely necessary to assure ignition of the warhead upon impingement of the projectile on the ground in any event.

At the end of the first phase of the firing method, the flight velocity in respect to both components of the direction is reduced considerably. The axis of the missile assumes a position approximately perpendicular to the tangent of the trajectory. Since it is not possible in actual practice to brake the horizontal component of velocity down to zero, an angle of inclination of the tangent to the trajectory considerably deviating from 90° will remain, for example, this angle will be in the order of 10°. According to a further detail of the method of the invention, the device for destabilizing the missile and/or the projectile is to be deactivated after achievement of a highly downwardly curved trajectory of about 80°.

In accordance with the invention, the apparatus for accomplishing the method includes, for example, a guide or control device such as a control fin or a parachute disposed at the rear end of the projectile or at its trailing end when it is descending over the target. After the downwardly curved trajectory is achieved, the restabilizing device becomes effective. When a parachute is employed for the destabilizing braking phase, the projectile may be reversed and continue in its flight with its rear end foremost.

During the step of restabilization, in accordance with the method of the invention, the axis of the missile is again directed into approximately the direction of the tangent to the trajectory, and the missile by acceleration due to gravity will gain in speed. Such acceleration can be effective in the vertical component of velocity direction only but not in the direction of the horizontal component. This means, that by continuous increase of the advancing velocity, the angle of incidence deviates more and more from the original value until it lies in a direction of the acceleration due to gravity when the impingement of the projectile occurs at the impact target area.

To carry out the method of the invention, a destabilizing control unit may, for example, be arranged at the head or tip of the warhead which when actuated will force the missile into a position at which the axis of the missile shifts in a direction substantially normal to the tangent of the trajectory. Instead of the employment of a destabilizing control, it is also possible to use a small parachute which is ejected outwardly at the proper time in the trajectory to produce a braking effect to destabilize the missile as desired. The efficiency of the element which is disposed at the tip of the missile must be great enough to achieve an increased air resistance which will place the missile in the position such that its axis is normal to the tangent of the trajectory at the effective point and to hold it destabilized in respect to the effectiveness of any existing control at such time.

Within a few seconds after braking the speed, either the forward control unit or a parachute or a similar rearwardly located control may be actuated or retracted so that either the stabilizing control unit at the tail of the missile, such as the stabilizing flaps, or the parachute at the nose, will again adjust the missile axis in a direction tangent to the trajectory. Thereafter, the missile is permitted to gain in speed by acceleration due to gravity. When a parachute is employed to destabilize the missile from its trajectory path, it may be left in an effective position and is preferably so dimensioned that it assumes stabilization in the vertical direction even if there is an existing tail control unit.

The missile or projectile for carrying out the method of the invention includes a compression member which is located so that it moves backwardly or is compressed upon impact of the missile to cause ignition to the explosive charge when the missile is oriented so that at least one of the charge-type liner elements of the warhead is disposed at a location corresponding to the maximum height of the target which is to be hit. This construction is particularly advantageous when the missile is constructed as a rocket-powered missile and the forward portion contains a parachute which is effective to lower the missile with its trailing end foremost and with the motor housing disposed toward the earth. In this reversed flight position, the motor housing with the burnt out rocket motor touches the ground first. With the ignition arrangement, the ground distance or height of the explosive charge for achieving optimum effect on the target is nevertheless maintained. The actuating device advantageously includes a telescopic or displaceable thrust bolt or rod member member which extends through the missile body and projects beyond the tail of the missile so that it contacts the ground first when the missile lands at impact.

Accordingly, it is an object of the invention to provide an improved method for firing and guiding a rocket propelled missile or a projectile with a warhead which comprises destabilizing the missile at a point of its ballistic trajectory and in such a manner that the axis of the missile adjusts to a direction substantially perpendicular to the tangent of the trajectory and the forward speed thereof is considerably reduced, readjusting the axis of the projectile by restabilization to the direction of the tangent to the trajectory, and permitting the speed of the missile to increase as it falls substantially vertically to the earth.

A further object of the invention is to provide an improved missile warhead and missile body construction which includes a casing surrounding an explosive charge having a plurality of hollow charge liners disposed in the casing around the charge and located in a plurality of axially spaced planes, and means associated with the missile adapted to contact the ground first upon impact of the missile at a target area for igniting the explosive charge at a location of the missile where at least one liner thereof is at a height from the ground which is substantially that of the height of the target.

A further object of the invention is to provide a missile which includes a missile body having a tubular warhead portion with a plurality of concave liners disposed around the circumference in a plurality of separate axially-spaced planes, and including means carried either at the tip, intermediate the length, or at the end of the missile for producing a destabilizing braking effect on the missile after the missile has received a predetermined trajectory, and with means for also providing a restabilizing effect on the missile to cause it to descend under the influence of the acceleration of gravity substantially vertically to the target.

A further object of the invention is to provide a guided missile construction which includes a forward end having separable tip elements for releasing a parachute for destabilizing and subsequently restabilizing the missile for substantially vertical approach to the target and which includes a missile body which is driven by a rocket motor arranged at the trailing end, and with means for igniting an explosive charge in the warhead portion of the body when the missile strikes the target area at ground level which will cause explosion of the charge when the charge is positioned at a height comparable to the maximum height of the target.

A further object of the invention is to provide a missile and/or warhead construction which is simple in design, rugged in construction and economical to manufacture.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
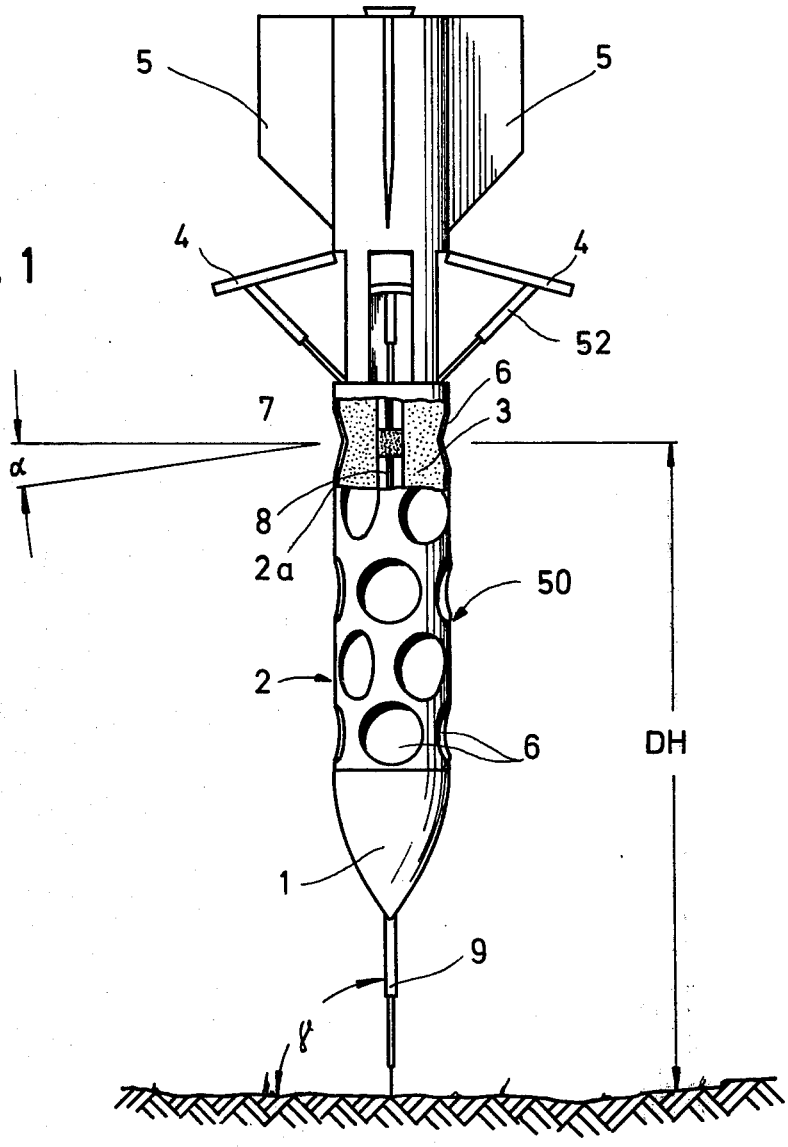
FIG. 1 is a side elevational view, partly in section, of a rocket projectile having a warhead constructed in accordance with the invention.
Figure 2:
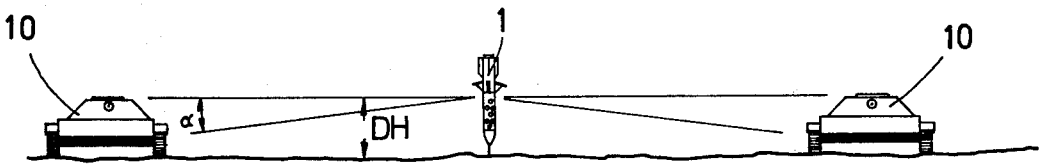
FIG. 2 is a schematic elevational view showing the missile at the point of impact on the ground in relation to a target such as a tank.

Referring to the drawings, in particular, the invention embodied therein in FIGS. 1 and 2 comprises a rocket projectile, generally designated 50, having a front portion or warhead cap 1 and a substantially cylindrical body 2 which carries guiding fins or stabilizing surfaces 5 at its trailing end.

In accordance with the invention, the body 2 includes a warhead portion comprising an annular explosive charge 3 having an outer cylindrical casing 2*a* which is provided with a plurality of concave liners 6 of the shaped charge-type arranged at spaced locations around the circumference and in a plurality of axially-spaced planes, the liners of the adjacent planes being offset. The cylindrical casing 2*a* is comparatively thin in comparison to the explosive charge liners 6. The selection of the number of liners depends on the height of the target which will be attacked. The selection must insure that the product of hit probability and penetration capacity is optimized. As the size of the liner is increased, the penetration capacity also increases but the number of liners on the periphery of the warhead will decrease.

On the basis of the minimum penetration capacity given by the thickness of the armor of the target, the minimum size of the liners must first be determined. The caliber of the warhead determines the number of liners which are employed in a plane. By multiplying this by the number of planes on which the liners are arranged, the total number of liners is obtained. The liners 6 form projectiles upon the detonation of the explosive charge 3. The optimum number of liners and their arrangement varies in accordance with the angle of impact $\gamma$ (FIG. 2). It also varies in accordance with the warhead axis, the ground inclination, and the overall thickness of the armor of the target, which in this instance is the tanks 10", 10" Firing tests have indicated that a sufficiently high hit and kill probability can be achieved with charge liners arranged in from 5 to 8 planes and employing between 4 and 6 liners per plane and using warhead diameters of from between 100 mm. (for example, against APCs) and 300 mm. (against heavy armored vehicles).

The liners 6 of adjacent planes are staggered and each plane is provided with its own point of explosive charge ignition initiation point, one of which is indicated at 7. The points of initiation 7 of the various liner planes are fired simultaneously by means of an ignition wire 8 interconnecting all of the points of initiation or by a percussion fuse in the warhead cap (not shown). The wire 8 is connected to and is actuated by a telescopic rod 9 which can be extended from the tip of the warhead. The length of the telescopic rod 9 is set so that the explosive charge 3 detonates at a height DH which, as shown in FIG. 2, corresponds to the height of the targets 10', 10' above the ground.

The basic assumption is that the highest kill probability is achieved with an angle of impact of $\gamma=90°$ and an impact velocity of between 120 and 200 meters per second. These narrow boundary conditions are characteristic for the warhead of this type. When the warhead is at rest, the liners are hurled off in the arrangement plane, that is, perpendicular to the warhead axis. In the case of a flying warhead, the angle of departure is determined by the ratio of the impact velocity of the warhead to the speed at which the liners are hurled off. At the impact velocity, the liners 6 will be hurled off in the present arrangement at an angle $\alpha$ of between 3° and 5° to the arrangement plane of the liner. This angle of departure is advantageous for compensating for the influence of ground inclination or small deviations from the ideal angle of impact $\gamma=90°$.

The missile body 50 also carries an intermediate portion between the tail surfaces 5 and the warhead which includes flap elements 4 which may be moved outwardly to the position indicated by suitable controls 52 which are actuable during the time at which the missile moves through a ballistic trajectory. In the extended position indicated, the flaps 4 provide a braking effect on the missile which causes to move out of its trajectory path and through a path which is substantially at right angles to a tangent to this path.

The operation of the missile is as follows. Depending on the firing range, the braking device which, in this embodiment, comprises the flaps 4 is actuated approximately above the target area. The original trajectory of the warhead is interrupted by a destabilization caused by the braking effect so that the axis of the missile moves in a direction perpendicular to the tangent to the original trajectory. Thereafter, control means such as the trailing flaps or fins 4 act to restabilize the missile as it moves downwardly under the acceleration force of gravity until it returns to a position at which the axis is substantially parallel to the tangent to the trajectory with the tail portion to the rear in the embodiment illustrated so that the missile falls substantially vertically downwardly and contacts the ground at the impact point in the position indicated in FIGS. 1 and 2. The rate of descent can be controlled by the braking device including the flaps 4, for example, by the amount at which the flaps are extended.

This missile body advantageously carries means (not shown) for extending the rod 9 and simultaneously setting the fuse mechanism (not shown). After impact, the rod 9 is retracted to cause ignition of the explosive charge 3.

Figure 3:
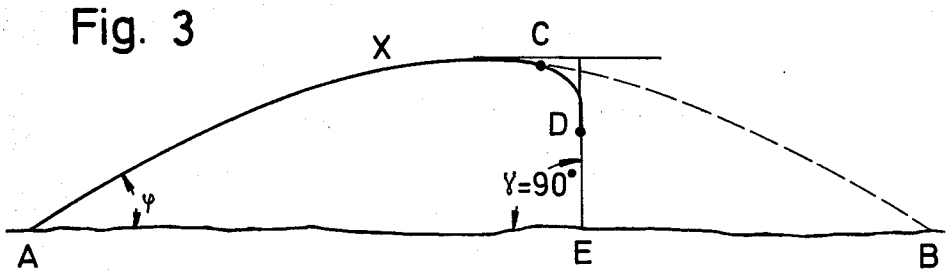
FIG. 3 is a schematic representation of the firing method according to the invention.

As indicated in FIG. 3, at the point A, the missile is started at an angle $\psi$ and it is programmed to reach a target lying at the point E. The trajectory which is defined, inter alia, by the angle $\psi$ describes a parabola and this parabola would normally terminate at the point B if it were not interrupted by the control means of the missile which is initiated at the predetermined point C. When the control means are actuated, for example, such as by the extending of the flaps 4 the missile is braked so that for a short time the missile axis is shifted so as to become positioned substantially perpendicular to the tangent to the trajectory. During this time the missile rapidly loses altitude. When the missile reaches point D, restabilization of its flight is effected such as by the guide fins 5 until the axis becomes oriented parallel to the trajectory and substantially vertical. The restabilization effects the gradual orientation of the axis of the missile from its position before D at a few degrees from the 90° angle of fall up to a substantially vertical fall angle when stabilization is completed. Impact at the target E occurs when the missile is substantially vertical and the angle $\gamma$ is 90°.

Figure 4:
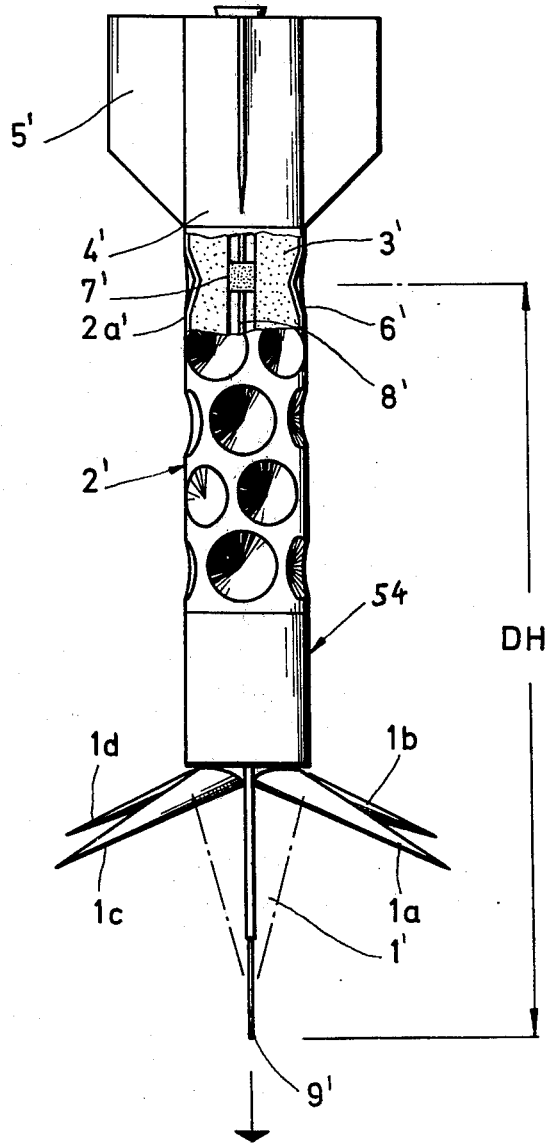
FIG. 4 is a side elevational view of another embodiment of a rocket projectile having extendable braking surfaces for carrying out the method of the invention.

In the embodiment illustrated in FIG. 4, there is provided a missile or rocket-powered projectile generally designated 54 which includes a front portion or cap 1', a body portion 2' and a trailing portion 4' having guide fins or stabilizing flaps 5'. In this embodiment, the cap 1' is subdivided into several spreader elements 1*a*, 1*b*, 1*c*, 1*d* which may be separated and moved outwardly from their cone-forming configuration indicated in dotted lines to their solid line positions at which they provide a braking effect on the missile. In this embodiment, as in the embodiment of FIG. 1, hollow charge liners 6' are provided around the periphery of an explosive charge 3' and are arranged within a thin walled cylindrical casing 2*a*'. For each liner plane, a specific initiation point is provided such as the point 7' for the uppermost liners 6' indicated in the drawings. All initiating points 7' are actuated simultaneously by an interconnecting ignition wire 8' as soon as an impact igniter (not shown) is actuated by a telescopic rod 9' which extends outwardly from the forward end of the missile. The telescopic rod 9' may be extended outwardly by an amount to cause ignition of the explosive charge 3' when one of the uppermost liners 6' is at the height DH indicated. This dimension DH corresponds to the height of the target to be attacked.

The projectile 54 moving along the trajectory A–B, as indicated in FIG. 3, becomes strongly curved at the location C when the spreader segments 1*a*, 1*b*, 1*c* and 1*d* are spread outwardly to the position indicated in FIG. 4. The spreader elements produce a destabilized normal positioning of the projectile relative to the tangent to the trajectory. This positions the axis of the missile at an angle of incidence of about 90°–10°.

In accordance with the next step of the method which takes place at the point D in FIG. 3, the restabilization of the missile is effected by retraction of the segments 1*a*, 1*b*, 1*c* and 1*d* by an amount sufficient to permit the desired rapid free fall of the missile under the influence of gravity. The missile accelerates until the guide fins 5' provide a stabilizing effect and effect the reorientation of the missile into the trajectory path bringing the axis to an angle of 90° from the horizontal, the attitude at which it strikes the ground upon impact.

Figure 5:
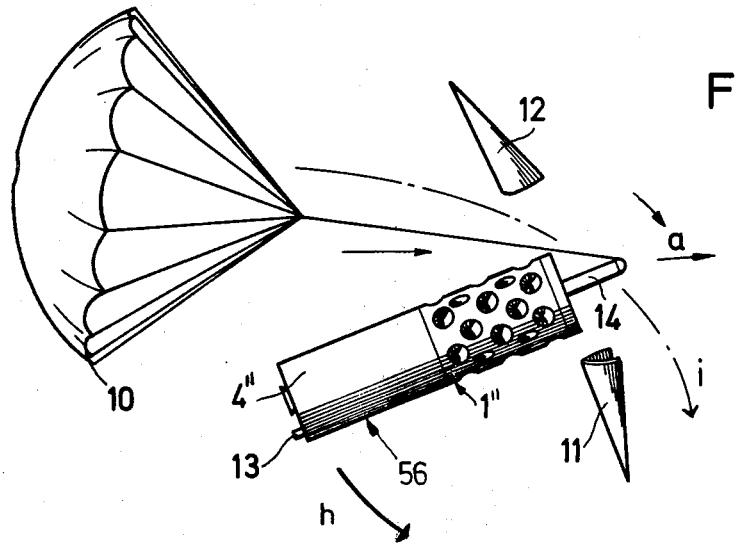
FIG. 5 is a side elevational view of still another embodiment of a rocket projectile in a position at which its trajectory is initially destabilized.
Figure 6:
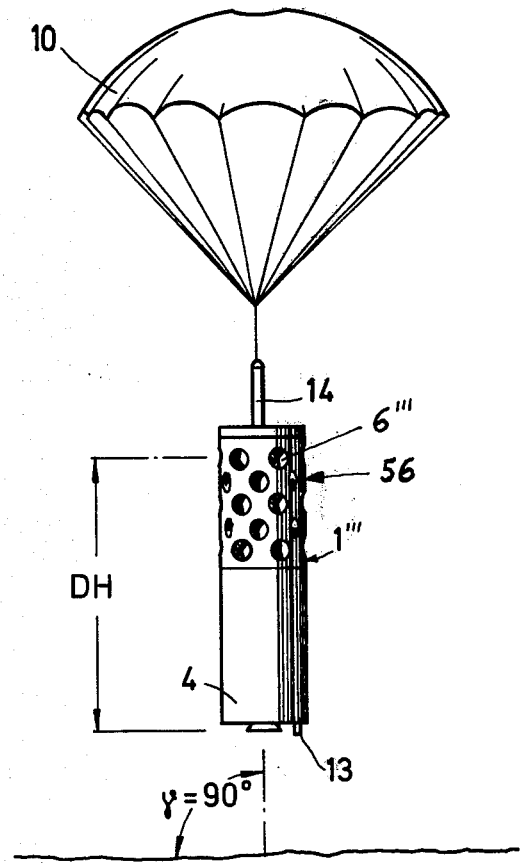
FIG. 6 is a side elevational view of the rocket indicated in FIG. 5 in the final flight phase.

In the embodiment illustrated in FIGS. 5 and 6, there is provided a rocket-powered missile or projectile generally designated 56 which includes a nose or cap formation at its front end provided by two half conical fairing plates 11 and 12. The fairing plates 11 and 12 enclose an anchor rod 14 to which is secured a parachute 10. Upon arrival at the point C of the trajectory indicated in FIG. 3, the fairing plates 11 and 12 are dropped and the parachute 10 unfolds. The parachute 10 first causes a major reduction of the horizontal speed of the projectile 56 and since it acts at the forward tip of the projectile body 1'' it turns the body in a direction of the arrow h until the axis is substantially perpendicular to tangent to the trajectory. After such destabilization, the trajectory of the projectile becomes strongly curved and moves in the direction of the arrow i. Immediately thereafter, a restabilization takes place when the projectile which is suspended from the parachute with its tail foremost falls to the ground with increasing speed produced by gravity. The axis of the projectile in this manner adjusts to a position which is coaxial to the tangent to the trajectory and the projectile impinges vertically to the ground at E.

Ignition of the explosive charge within the body 1'' is effected by the inward movement or compression of an igniter bolt 13 which is disposed at the tail of the projectile 56. The liners 6'' are arranged so that at least the ones in the upper plane are at an elevation DH comparable to the height of the target when impact occurs.

Tests have shown that the missile 56 becomes restabilized a few seconds after the braking and destabilizing phase and that it then falls to the ground substantially vertically.

The missile 56 thereafter accelerates under the influence of gravity as it is suspended by the parachute 10 with its trailing end forward. The axis of the projectile will readjust to a position coaxial to the tangent to the trajectory and the projectile will impinge vertically on the ground at E. The igniter bolt 13 which is disposed in the tail of the projectile effects ignition of the charge within the body 1''' so that the charge will be exploded adjacent the liners 6''' at a height DH equivalent to the height of the target.

Tests have shown that the missile will be restabilized a few seconds after the braking is begun such as by the parachute or by the extending flaps 4 and the destabilization phase will be overcome until the missile then falls to the ground practically vertically. In dimensioning the parachute, it is observed that the missile undergoes only minor circular oscillations which means that the circular oscillation has to be damped.

What is claimed is:

1. A ground-to-ground missile construction for use against an armored target or the like arranged to be fired in a parabolic trajectory extending generally in the horizontal direction comprising an axially extending body having a head portion at the forward end and a tail portion at the rearward end in the as fired position of the missile, a tubular casing portion adjacent said head portion and extending rearwardly therefrom in the axial direction of said body and having an explosive charge disposed therein, braking and stabilizing means carried by said body in the head portion thereof and being selectively deployable outwardly from the head portion of said body for temporarily destabilizing the missile out of its as fired parabolic trajectory path and turning the missile approximately 90° with the axis of said body portion being displaced from a generally horizontal position to a generally vertical position and with said head portion positioned vertical above said tail portion by decreasing the speed thereof whereby upon restabilization the missile drops substantially vertically with the tail portion thereof leading in the downward direction trailed by the head portion onto the target, and an ignition device mounted on and projecting outwardly from said tail portion in the axial direction of said body and connected to said charge so that when said tail portion lands at the target area said ignition device extending said tail portion contacts the target area and explodes the charge.

2. A missile, according to claim 1, wherein said braking and stabilizing means comprises a parachute carried within said head portion.

3. A missile, according to claim 1, wherein said head portion includes separable parts displaceable from said body for releasing said braking and stabilizing means, and said braking and stabilizing means includes a parachute located in said head portion inwardly of said separable parts.

* * * * *